US005104039A

United States Patent [19]

Oestmann

[11] Patent Number: 5,104,039

[45] Date of Patent: Apr. 14, 1992

[54] RAILROAD TIE

[75] Inventor: Roger K. Oestmann, Post Falls, Id.

[73] Assignee: CXT Incorporated, Spokane, Wash.

[21] Appl. No.: 660,282

[22] Filed: Feb. 22, 1991

[51] Int. Cl.[5] ..... E01B 3/00

[52] U.S. Cl. ..... 238/106; 238/91

[58] Field of Search ..... 238/106, 100, 98, 91, 238/85, 84, 83, 29

[56] References Cited

U.S. PATENT DOCUMENTS

| | | | |
|---|---|---|---|
| 530,778 | 12/1894 | Ingersoll . | |
| 690,138 | 12/1901 | Ford | 238/91 |
| 692,372 | 2/1902 | Sheffield | 238/106 X |
| 704,932 | 7/1902 | Reitz et al. | 238/106 X |
| 730,059 | 6/1903 | Tassel | 238/106 X |
| 863,987 | 8/1907 | Hamilton | 238/106 X |
| 1,072,932 | 9/1913 | Fairweather | 238/106 X |
| 1,074,014 | 9/1913 | Proctor | 238/106 X |
| 1,209,477 | 12/1916 | Muse | 238/106 X |
| 1,244,616 | 10/1917 | Kruse | 238/106 |
| 1,616,266 | 2/1927 | Lacey | 238/106 X |
| 1,720,473 | 7/1929 | Habicht . | |
| 1,888,287 | 11/1932 | Prot . | |
| 2,128,530 | 8/1938 | Hadley | 238/84 |

*Primary Examiner*—Frank E. Werner
*Assistant Examiner*—James T. Eller, Jr.
*Attorney, Agent, or Firm*—Wells, St. John & Roberts

[57] ABSTRACT

A railroad tie 10 is described. The tie includes elongated side surfaces 23 with a plurality of ballast locking indentations 34 formed therein. The indentations converge from open upward ends 35 to reduced bottom ends 36. The configuration of the locking indentations at the bottom ends is such that the indentations will receive the maximum aggregate size within the ballast. The tie body, provided with the indentations, and relationship of the sides 23 to the indentations 34 is such that maximum resistance is offered by the tie to longitudinal movement of the tie in the ballast with respect to the tie length dimension.

10 Claims, 3 Drawing Sheets

RAILROAD TIE

TECHNICAL FIELD

The present invention relates to railroad ties with provisions for reducing lengthwise movement thereof within railroad bed ballast.

BACKGROUND OF THE INVENTION

There has always been a need in the railroad industry for ties with provisions to maximize resistance to motion along the tie length dimension. Such motion occurs in response to forces applied by weather conditions, and by the passage of trains along the rails. The problem of "tie movement" is most realized in areas where the rails curve. The rails in such areas are subjected to substantial lateral forces from the trains moving around the turns. Ties are also additionally subjected to forces applied by the rails themselves as they expand and contract in cold and warm weather conditions. The problem is amplified with the new "ribbon" rails that extend for substantial distances without joints.

One solution to the problem of lateral track movement is the provision for more railroad ties and closer spacing in areas where the track curves. This is not economically effective as railroad ties are becoming increasingly expensive.

The above problem is addressed in U.S. Pat. No. 1,888,287 to Prot which discloses a "ferro-concrete rail-way sleeper". The configuration of the tie includes an enlarged foot used to distribute vertical loading and minimize pressure on the ground surface. The tie is hollow along its length and includes a substantially rectangular central cross section adjacent the areas between rail mounting surfaces thereof. Webbing is provided at the rail mounting surfaces extending angularly downward from the rail mounting surfaces to the widened foot. Resistance to "side stresses" is claimed to be increased by provision of diverging ribs provided at the end portions of the sleeper.

Another attempted solution to the above problem is found in U.S. Pat. No. 1,720,473 to Habicht which discloses a railroad tie with a specific configuration intended to hold position within ballast. This tie construction includes a substantially triangular cross sectional configuration in which the top, flat surface of the tie represents one side of the triangular cross sectional configuration. Thus, the side walls converge downwardly in areas of the tie with the exception of those areas mounting the rails. It is stated that this form of tie configuration will afford a more uniform distribution of load on the surrounding ballast and will retain its position within the ballast.

U.S. Pat. No. 530,778 to Ingersoll discloses a tie configuration that is approximately opposite in cross sectional configuration to the Habicht reference discussed above. Here, end and central side surfaces of the tie diverge from the top surface to an enlarged foot at the bottom portion of the tie. Again, this configuration is claimed to effectively prevent endwise movement of the ties.

While the above ties may indeed improve traction and distribution of load, it remains desirable to obtain maximum resistance to lateral tie movement, especially when ties are used in conjunction with elongated, seamless "ribbon" rails. In doing so, it is desirable to obtain maximum traction of such ties within the aggregate forming the roadbed. Thus, it is the primary objective of the present invention to provide a tie configuration of economically feasible construction and that will provide maximum grip within a prepared aggregate ballast.

BRIEF DESCRIPTION OF THE DRAWINGS

A preferred form of the invention is illustrated in the accompanying drawings in which.

DETAILED DESCRIPTION OF THE PREFERRED EMBODIMENTS

Figure 1:
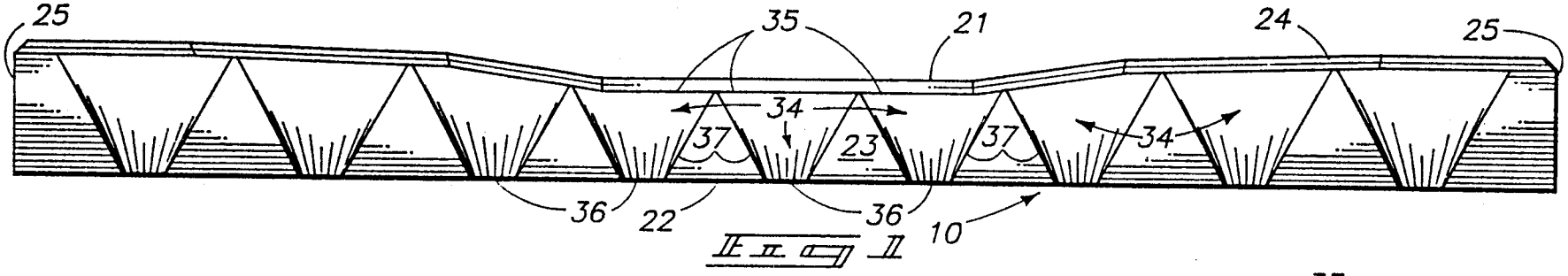
FIG. 1 is a frontal elevation view of a railroad tie according to principles of the present invention.

This disclosure of the invention is submitted in furtherance of the constitutional purposes of the Patent Laws "to promote the progress of science and useful arts" (Article 1, Section 8).

A preferred form of the present tie is generally indicated in the drawings by the reference character 10. The present tie 10 is intended to be placed within screened or otherwise graded ballast 11 made up of various sized aggregate 12. In accordance with standard practice, such ballast include an aggregate up to a size of approximately 2.50 inches. Such ballast is typically gravel and stone that has been screened or otherwise graded and is carefully placed in preparation for receiving ties and rails. The use of aggregate and ballast and the placement of such ballast is well known to the railroad industry and need not be discussed in further detail herein. It is sufficient to note that the typical maximum aggregate size at the roadbed level and within the ballast area for a standard tie configurations is the 2.50 inches cited above.

Figures 6, 7:
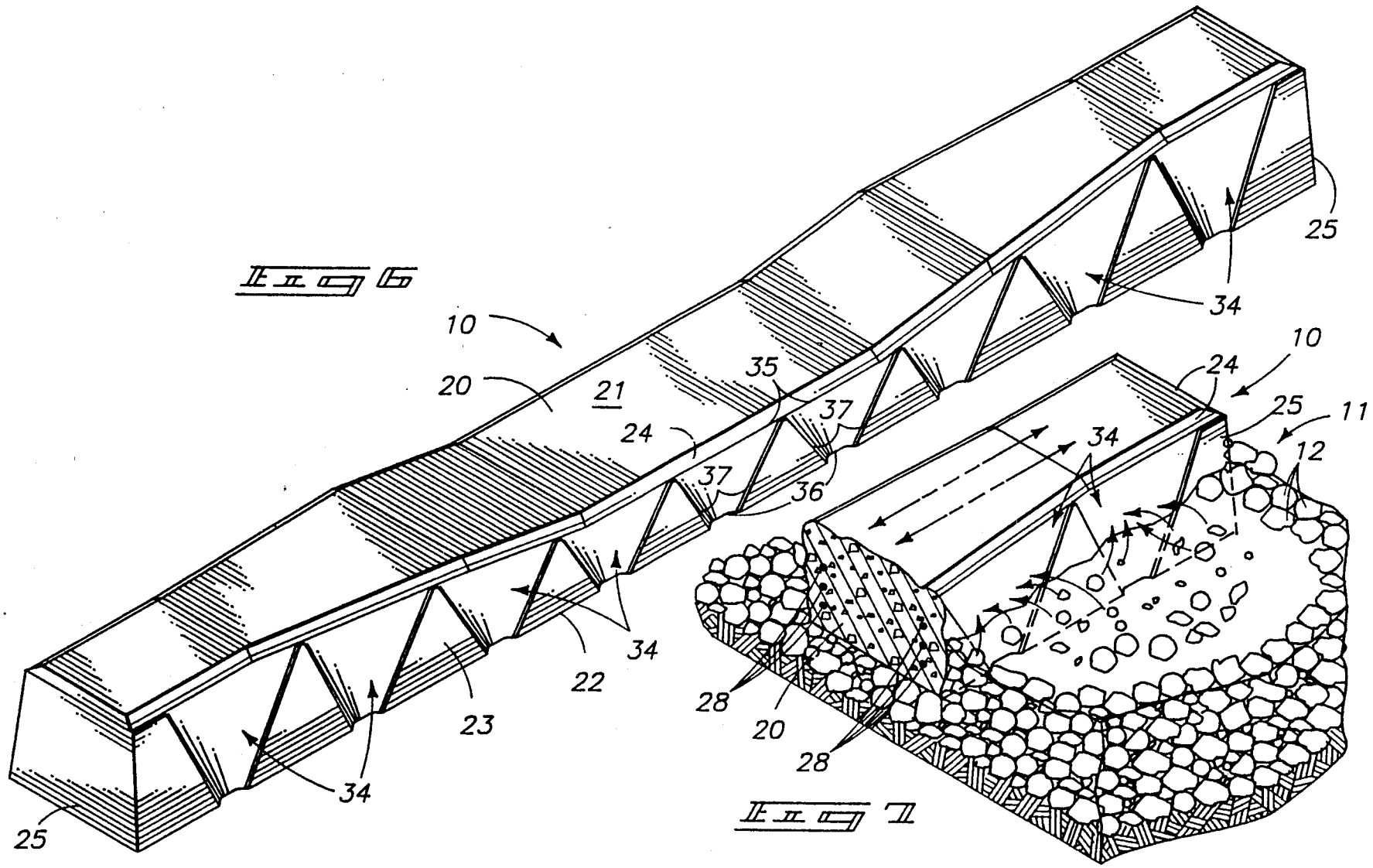
FIG. 6 is a perspective view of the present tie configuration.
FIG. 7 is a fragmented diagrammatic view illustrating placement of a portion of the present tie configuration in ballast.

For purposes of illustration, a portion of railroad ballast 11 is shown in FIG. 7 of the drawings. It is pointed out that the showing is merely exemplary of approximate aggregate size and is not intended to show actual ballast layering, composition, etc.

The present tie 10 is comprised of an elongated tie body 20. The tie body, in the preferred form, is constructed of reinforced concrete, cast by conventionally known techniques. It has been found that reinforced concrete, is advantageously used due to the unique configuration of the present tie 10, and for the strength and reliability of the reinforced concrete product.

The tie body 20 includes a longitudinal top surface 21 and a substantially parallel opposed bottom surface 22. The top surface 21 may be stepped as indicated in FIG. 1, or may take other configurations where appropriate. The bottom surface 22 likewise may be substantially flat as indicated, or may be provided with textured configurations as desired.

The top and bottom surfaces 21, 22 extend the full length of the tie body and are separated by longitudinal side surfaces 23. The side surfaces 23 are, in the preferred form, divergent from the top surface 21 to the bottom surface 22. A bevel 24 joins the top surface 21 and the side surfaces 23 in the preferred configuration. The tie top surface 21, bottom surface 22, and side surfaces 23 all extend the length of the tie between opposed transverse end surfaces 25.

In the preferred configuration, reinforcing rods 28 are provided within the tie adjacent to the opposed side surfaces 23. The rods 28 are placed according to conventional technique known in the art of concrete tie construction.

An important aspect of the present invention is the provision of the number of ballast locking indentations 34 along the side surfaces 23. It is pointed out that there are a plurality of the indentations formed along the full length of each side surface 23. The indentations provide the capability along the full length of the tie exposed to the ballast aggregate 12, for interlocking with the aggregate 11 and therefore providing substantial resistance to movement along the tie length.

The individual indentations are substantially indentical, or at least have similar characteristics, one to the other along the opposite sides of the tie.

Each indentation 34 includes a longitudinally enlarged top end 35 that, in a preferred form, is open along the top surface 21. The indentation then tapers downwardly to a reduced bottom end 36. In the preferred form, the reduced bottom ends 36 open along the bottom surface 22. Thus, each indentation 34 has a somewhat funnel configuration, formed into the side surface of the tie body. The funnel configurations are partially defined between converging indention side edges 37, and the exposed side surfaces of the tie between the edges 37, the top ends 35, and the bottom ends 36.

Figure 4:
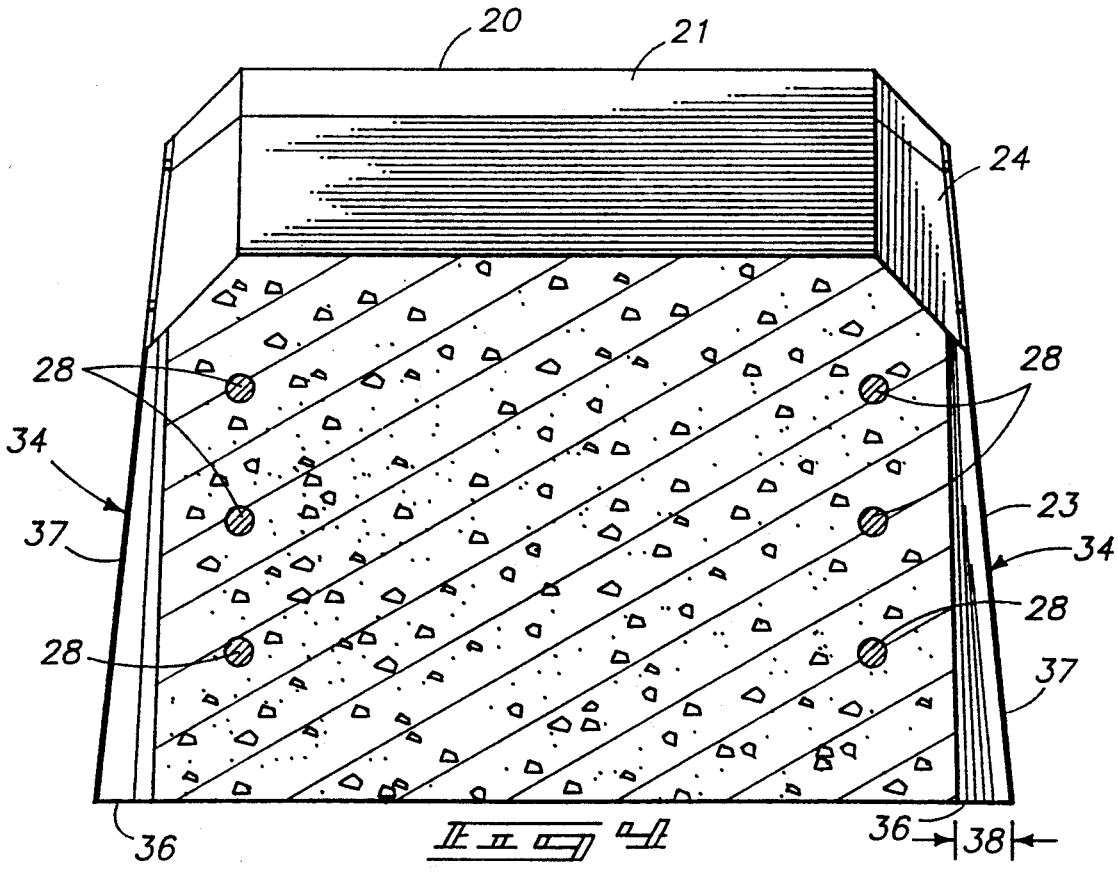
FIG. 4 is an enlarged sectional view taken substantially along line 4—4 in FIG. 2.

The indentations include a depth dimension identified by numeral 38 in FIG. 4. The depth dimension tapers from a maximum depth dimension 38 of approximately 0.5 inches or, more preferably, about 0.56 inches. The depth dimension 38 in the preferred form occurs at the bottom ends 36 of the indentations.

Figure 5:
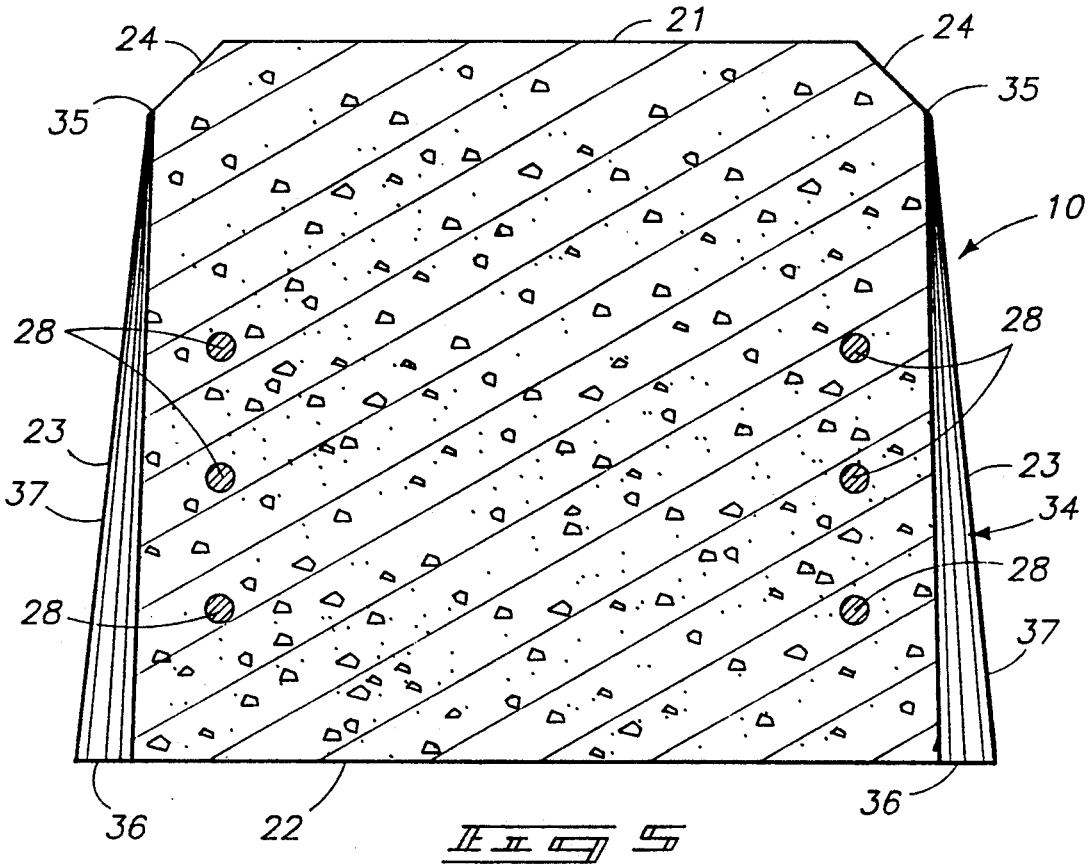
FIG. 5 is an enlarged cross sectional view taken substantially along line 5—5 in FIG. 2.

The depth dimension 38 decreases toward the top surface 21 as indicated in FIGS. 4 and 5, and as may be seen in the perspective view of FIG. 6 where the depth dimension is less than 0.50 inches. This configuration contributes to a ballast interlocking effect between the tie and the surrounding ballast aggregate.

Figure 2:
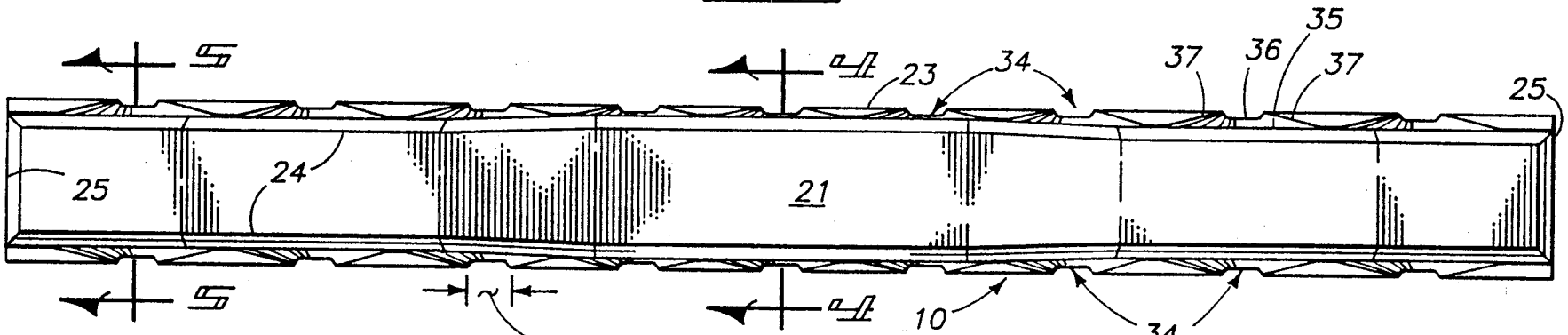
FIG. 2 is a top plan view of the present preferred tie configuration.
Figure 3:
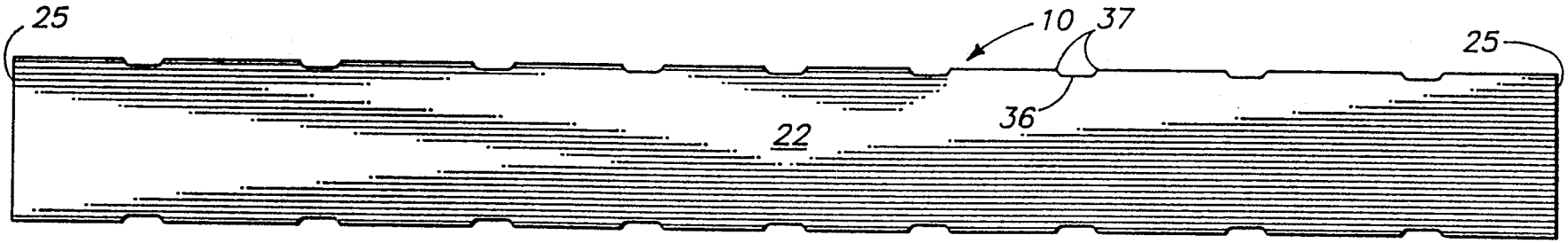
FIG. 3 is a bottom plan view of the present tie.

Another dimension, measured along the length of the tie along each of the ballast locking indentations at its open bottom end 36 is shown in FIG. 2 by the reference numeral 39. This dimension 39, in the preferred form, is intended to match or correspond substantially with the largest aggregate size used in the ballast 11. Thus, in the preferred form, the dimension 39 is approximately 2.50 inches. Indentation edges 37 diverge upwardly from the ends 36 to open top ends 35 having dimensions along the length of the tie that are substantially greater than 2.50 inches.

The dimensions 38, 39 of the indentations exemplified above are selected to correspond substantially with the ballast being used in the road bed, and may vary accordingly. However, the funnel configurations will consistently be shaped such that settling ballast will become gradually and more firmly interlocked with the various indentations along the length of the tie. This feature has been found to very substantially increase the resistance to longitudinal movement of the tie (with respect to its length) in ballast situations.

In practice, the present tie is placed within the ballast using known, conventional placement techniques. In fact, the present tie may be placed using all previously used placement techniques and tamping considerations as have been used in conventional track building practices. The advantage of the present tie's capability to resist movement along its length with the ballast is realized through the particular configurations described above such that the tie becomes substantially interlocked with the aggregate surrounding the tie. The settling aggregate will, in the vicinity of the various indentations, engage the converging side surfaces of the indentation and consolidate as they settle downwardly. The aggregate therefore gradually becomes wedged within the various indentations, and with one another to thereby become relatively integral. This situation leads to a dramatic resistance to lateral movement by the tie as applied either by testing equipment, or by rails in actual practice.

The present tie includes the further advantage in that the amount of materials used to construct the present tie is equal to or less than that required for conventional tie configurations.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A concrete railroad tie for placement in ballast wiht aggregate having a maximum dimension, comprising:

an elongated tie body defining a longitudinal axis along its major length, said tie body including a longitudinal top surface for placement of a railway rail thereon, a bottom surface, and two opposed outside surfaces extending between opposed transverse ends;

said tie body including a plurality of ballast locking indentations formed therein along the two opposed outside surfaces, each indentation extending between the top surface and the bottom surface, each indentation converging downwardly from an enlarged top end having an enlarged width dimension measured along the longitudinal axis to a reduced bottom end having a reduced width dimension measured along the longitudinal axis, said reduced bottom end extending to and opening at the bottom surface of the tie body, said enlarged top end extending to and opening at the top surface of the tie body, said reduced width being substantially equal to the maximum size dimension aggregate.

2. A railroad tie as claimed by claim 1 wherein the body includes reinforcing members extending longitudinally within the body, adjacent the outside surfaces between the body ends.

3. A railroad tie as claimed by claim 1 wherein the body sides diverge laterally with respect to the elongation of the body from the top surface to the bottom surface.

4. A railroad tie as claimed by claim 1 wherein the reduced width dimension of the reduced bottom end is approximately 2.5 inches.

5. A railroad tie as claimed by claim 1 wherein each indentation includes a depth dimension measurable inwardly into the tie body from the adjacent side surface, and wherein the depth dimension tapers from a maximum dimension at the bottom indentation end to a minimum dimension at the top indentation end.

6. A railroad tie as claimed by claim 1 wherein each indentation includes a depth dimension measurable inwardly into the tie body from the adjacent side surface, and wherein the depth dimension tapers from a maximum dimension of approximately 0.5 inches at the bottom indentation end to a minimum dimension less than 0.5 inches at the top indentation end.

7. A railroad tie as claimed by claim 1 wherein the reduced width dimension of the reduced bottom end is approximately 2.5 inches; and wherein each indentation includes a depth dimension measurable inwardly into the tie body from the adjacent side surface, and wherein the depth dimension tapers from a maximum dimension of approximately 0.5 inches at the bottom indentation end to a minimum dimension less than 0.50 inches at the top indentation end.

8. A railroad tie as claimed by claim 1 wherein the body sides diverge laterally with respect to the elongation of the body from the top surface to the bottom surface; and wherein each indentation includes a depth dimension measurable inwardly into the tie body from the adjacent side surface, and wherein the depth dimension tapers from a maximum dimension of approximately 0.5 inches from the adjacent side surface at the bottom indentation end to a minimum dimension less than 0.5 inches at the top indentation end.

9. A concrete railroad tie for placement in ballast with aggregate having a maximum dimension, comprising:

an elongated tie body defining a longitudinal axis along its major length, said body including a longitudinal top surface for placement of a railway rail thereon, a bottom surface, and two opposed outside surfaces extending between opposed transverse ends;

said tie body including a plurality of ballast locking indentations formed therein along the two opposed outside surfaces, each indentation extending between the top surface and the bottom surface, each indentation converging downwardly from an enlarged top end having an enlarged width dimension measured along the longitudinal axis to a reduced bottom end having a reduced width dimension measured along the longitudinal axis, said reduced width being substantially equal to the maximum size dimension aggregate; and each indentation inlcuding a depth dimension measurable inwardly into the tie body from the outside surface, said depth dimension tapering form a maximum dimension at the reduced bottom end to a minimum dimension at the enlarged top end.

10. A railroad tie as claimed by claim 9 wherein the reduced width dimension of the reduced bottom end is approximately 2.5 inches; and wherein the depth dimension of each indentation tapers from a maximum dimension of approximately 0.5 inches at the bottom indentation end to a minimum dimension less than 0.5 inches at the top indentation end.

* * * * *